US005163344A

United States Patent [19]

Mathers

[11] Patent Number: 5,163,344

[45] Date of Patent: Nov. 17, 1992

[54] ADJUSTABLE SOCKET APPARATUS

[76] Inventor: William S. Mathers, P.O. Box 1478 Citadel, Charleston, S.C. 29409

[21] Appl. No.: 779,043

[22] Filed: Oct. 18, 1991

[51] Int. Cl.[5] ..... B25B 13/06

[52] U.S. Cl. ..... 81/124.5; 81/185

[58] Field of Search ..... 81/124.5, 124.4, 124.6, 81/124.7, 185, 185.2, DIG. 11

[56] References Cited

U.S. PATENT DOCUMENTS 1,896,949 2/1933 Geiner ..... 81/185

3,233,482 2/1966 Jaehne ..... 81/185

FOREIGN PATENT DOCUMENTS 1288920 9/1972 United Kingdom ..... 81/185

*Primary Examiner*—D. S. Meislin

*Attorney, Agent, or Firm*—Leon Gilden

[57] ABSTRACT

An adjustable socket includes a plurality of sleeves concentrically aligned relative to one another and arranged in a biased orientation towards the lower terminal end of an associated socket, including interlocking projections to maintain the sleeves in a nested concentric relationship adjacent the lower terminal end of the socket, wherein the sleeves are selectively displaced, with each sleeve including a separate spring member to maintain each respectively sleeve in the coaxial relationship.

2 Claims, 4 Drawing Sheets

ADJUSTABLE SOCKET APPARATUS

BACKGROUND OF THE INVENTION

1. Field of the Invention

The field of invention relates to socket apparatus, and more particularly pertains to a new and improved adjustable socket apparatus wherein the same is arranged to permit selective deflection of individual or a plurality of sleeves to accommodate fasteners of various types introduced into the socket.

2. Description of the Prior Art

Adjustable socket apparatus of various types have been utilized in the prior art but heretofore have been of a cumbersome or awkward construction discouraging their use. Prior art structure is exemplified in U.S. Pat. No. 4,528,875 to Hurst, et al. wherein a socket structure includes sleeve members and the sleeves are maintained in alignment relative to one another by radial projecting fingers directed through the side wall of the socket.

U.S. Pat. No. 4,840,094 to Macaror sets forth a multiple socket wrench structure including a stepped-sleeve structure arranged for accommodating various size fasteners directed therewithin.

U.S. Pat. No. 3,738,203 to Cudd sets forth a wrench structure wherein various flats or flanges are introduced into opposing sides of the wrench to provide for accommodate of various size fasteners.

As such, it may be appreciated that there continues to be a need for a new and improved adjustable socket apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of socket apparatus now present in the prior art, the present invention provides an adjustable socket apparatus wherein the same is arranged to provide for concentric sleeves arranged in a sliding relationship relative to one another to accommodate various size fasteners introduced within the socket structure. As such, the general purpose of the present invention, which will be described subsequently in greater detail, is to provide a new and improved adjustable socket apparatus which has all the advantages of the prior art socket apparatus and none of the disadvantages.

To attain this, the present invention provides an adjustable socket including a plurality of sleeves concentrically aligned relative to one another and arranged in a biased orientation towards the lower terminal end of an associated socket, including interlocking projections to maintain the sleeves in a nested concentric relationship adjacent the lower terminal end of the socket, wherein the sleeves are selectively displaced, with each sleeve including a separate spring member to maintain each respective sleeve in the coaxial relationship.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved adjustable socket apparatus which has all the advantages of the prior art socket apparatus and none of the disadvantages.

It is another object of the present invention to provide a new and improved adjustable socket apparatus which may be easily and efficiently manufactured and marketed.

It is a further object of the present invention to provide a new and improved adjustable socket apparatus which is of a durable and reliable construction.

An even further object of the present invention is to provide a new and improved adjustable socket apparatus which is susceptible of a low cost of manufacture with regard to both materials and labor, and which accordingly is then susceptible of low prices of sale to the consuming public, thereby making such adjustable socket apparatus economically available to the buying public.

Still yet another object of the present invention is to provide a new and improved adjustable socket apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 10 is an orthographic cross-sectional illustration, taken along the lines 10—10 of FIG. 9 in the direction indicated by the arrows.

DESCRIPTION OF THE PREFERRED EMBODIMENT

Figure 1:
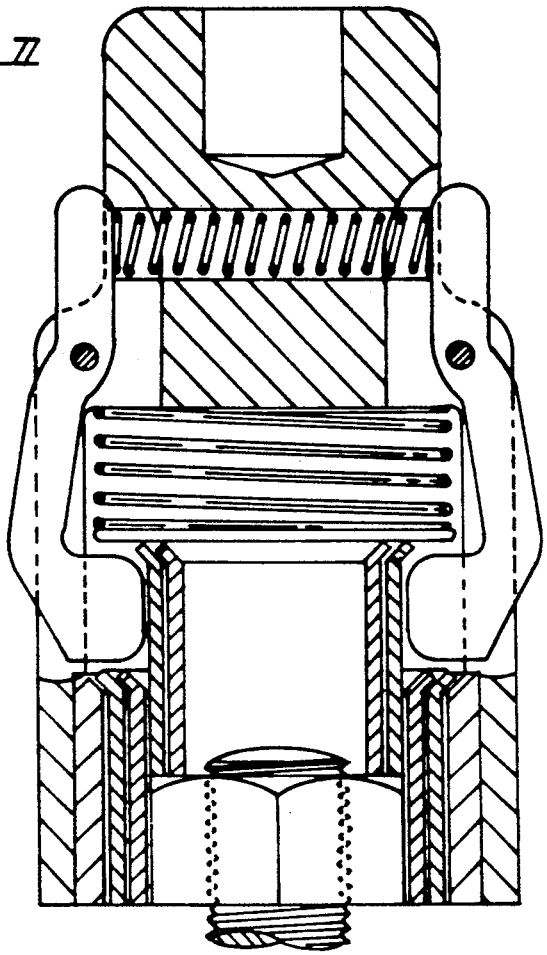
FIG. 1 is an orthographic cross-sectional illustration of a prior art adjustable socket structure.

With reference now to the drawings, and in particular to FIGS. 1 to 11 thereof, a new and improved adjustable socket apparatus embodying the principles and concepts of the present invention and generally designated by the reference numeral 10 will be described.

More specifically, the adjustable socket apparatus 10 of the instant invention essentially comprises a hexagonal parallelepiped main body 11, to include an upper body 12 coaxially aligned with the upper body 12 formed of a cylindrical configuration. It should be further noted, however, that the main body 11 may also be formed of a cylindrical configuration coextensive with that of the upper body 12 as the parallelepiped main body 11 is arranged to provide for wrench flats in accommodating a wrench structure for securement thereto. A square section bore 13 is concentric with and coextensive with the upper body 12 to receive a square drive member (not shown) of conventional construction.

Figure 5:
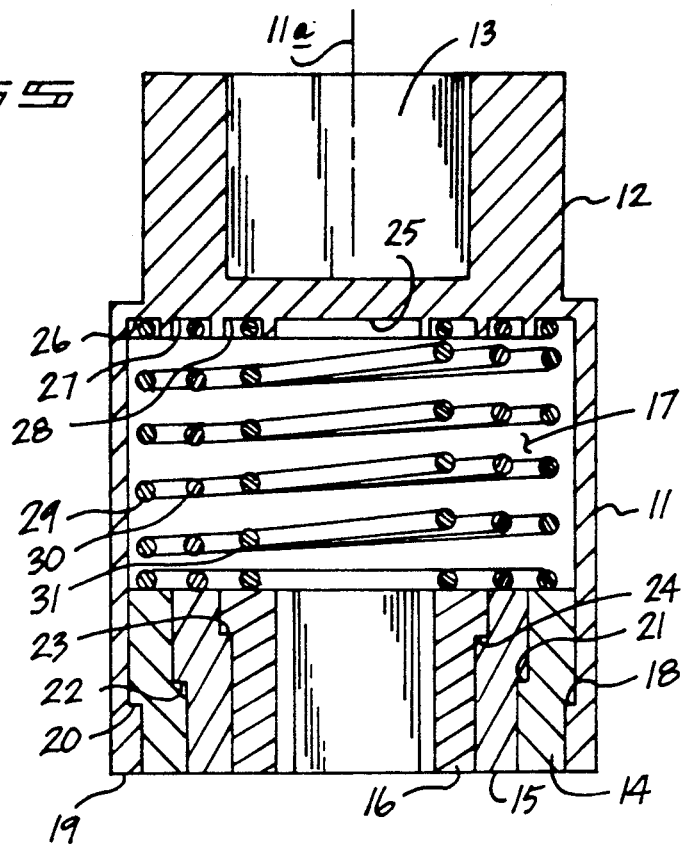
FIG. 5 is an orthographic view, taken along the lines 5—5 of FIG. 2 in the direction indicated by the arrows.
Figure 6:
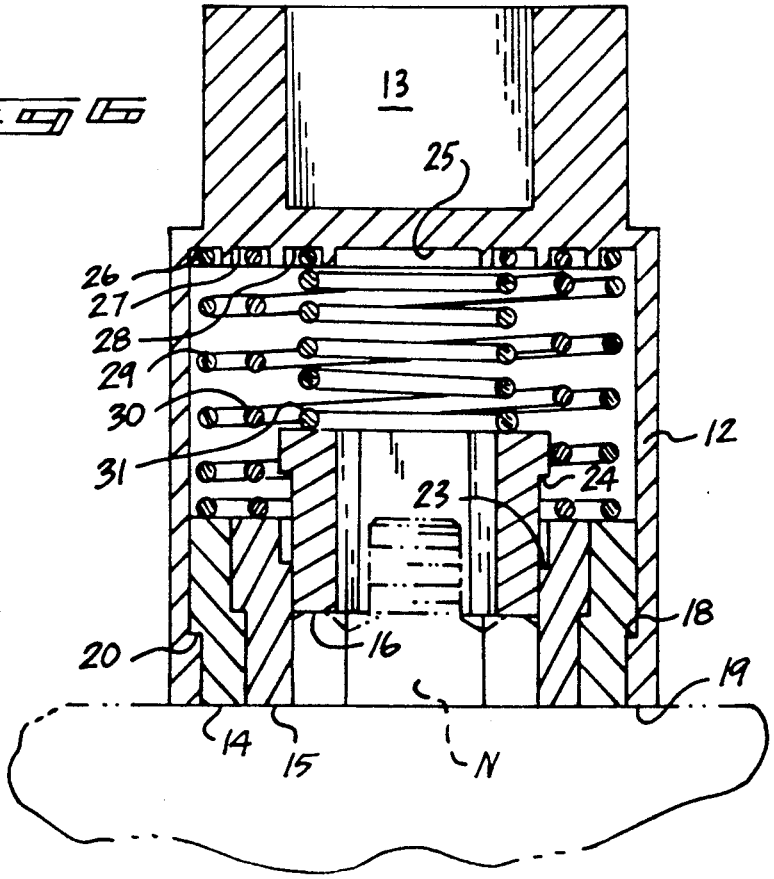
FIG. 6 is an orthographic cross-sectional illustration of the apparatus illustrating a displaced inner sleeve to accommodate a fastener directed into the socket structure.

A respective first, second, and third hexagonal tubular sleeve 14, 15, and 16 are mounted within the main body 11 and are each formed of a predetermined height less than a main body height defined by the main body. Each sleeve is arranged in concentric alignment relative to one another in a first position and are maintained in a coaxially aligned relationship in a displaced second position, such as illustrated in FIG. 6, when displaced from the first position, such as illustrated in FIG. 5. The main body and upper body, as well as the sleeves, are defined about a central axis 11a.

The main body 11 includes a main body cavity 17 coaxially aligned with the central axis 11a and formed with a main body lower terminal end 19. A main body shoulder 18 extends into the cavity 17 from the lower terminal end 19 a predetermined first spacing. A first sleeve outer projection 20 is formed exteriorly of the first sleeve 14 and is formed a first spacing from a lower terminal end of the first sleeve to be received on the main body shoulder 18 to prevent projection of the first sleeve beyond the lower terminal end 19. A first inner projection 21 is spaced from the lower terminal end 19 a second spacing and cooperates with a second sleeve outer projection 22 spaced from the lower terminal end 19 a second spacing. A second sleeve inner projection 23 is formed to an inner surface of the second sleeve and spaced from the lower terminal end 19 a third spacing cooperating with the third sleeve outer projection 34 spaced from the lower terminal end the third spacing to maintain the sleeves in a concentric alignment in the first position, as illustrated in FIG. 6. The cavity 17 is defined by the main body lower terminal end and by a main body cavity roof 25 at an upper terminal end within the main body 11, wherein the roof 25 is orthogonally oriented relative to the axis 11*a*. The roof includes a plurality of concentric grooves coaxially aligned about the central axis 11*a* defined by a first groove positioned in alignment above the first sleeve 14, a second groove aligned and above the second sleeve 15, and a third groove aligned and positioned above the third sleeve 16. A first spring 29 extends from the first groove to a top surface of the first sleeve, a second spring 30 extends from the second groove onto a top surface of the second sleeve, and a third spring 31 extends from the third groove 28 to a top surface of the third sleeve 16. The springs, as illustrated, are concentric relative to one another and coaxially aligned relative to the axis 11*a*.

Figure 7:
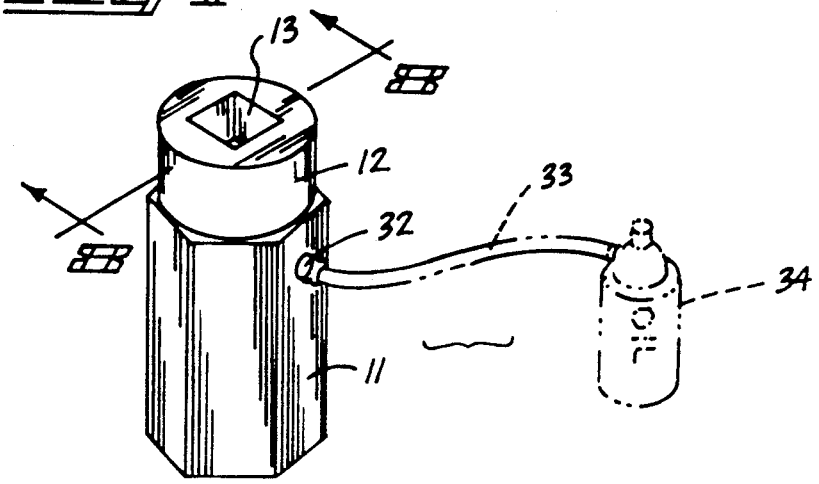
FIG. 7 is an isometric illustration of a modified socket structure.
Figure 11:
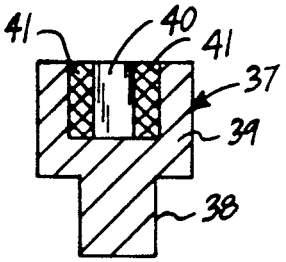
FIG. 11 is an orthographic cross-sectional illustration of section 11, as set forth in FIG. 8.
Figure 8:
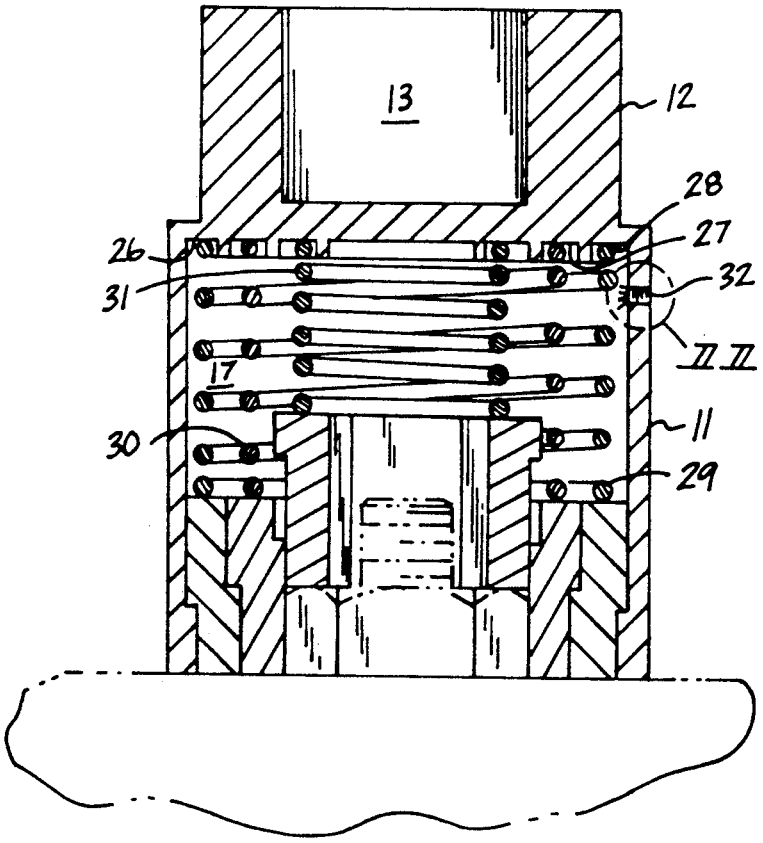
FIG. 8 is an orthographic view, taken along the lines 8—8 of FIG. 7 in the direction indicated by the arrows.
Figure 11:
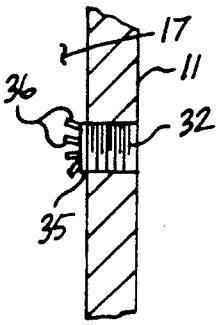

The FIGS. 7, 8, and 11 illustrate the use of an oil injection port 32 formed with internal threads directed through the main body 11 in communication with the cavity 17 spaced above the sleeves 14–16. The port 32 includes a venturi plate 35, including a plurality of splayed venturi plate conduits 36 directed through the venturi plate 35 to provide fluid communication between the port 32 and the cavity 17. An oil injection conduit 33 is securable to the port 32 and is in fluid communication with a pump and reservoir 34 to direct lubricating and anti-corrosive oil lubricant interiorly of the cavity to provide for lubrication and maintenance of the organization in use.

Figure 9:
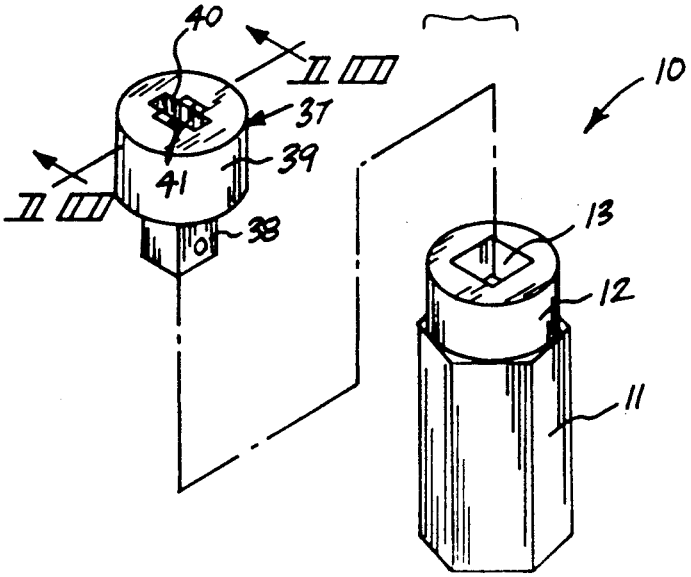
PRIOR ART Fig 9
FIG. 9 is an isometric illustration of an adapter structure utilized by the socket of the instant invention.
Figure 2:
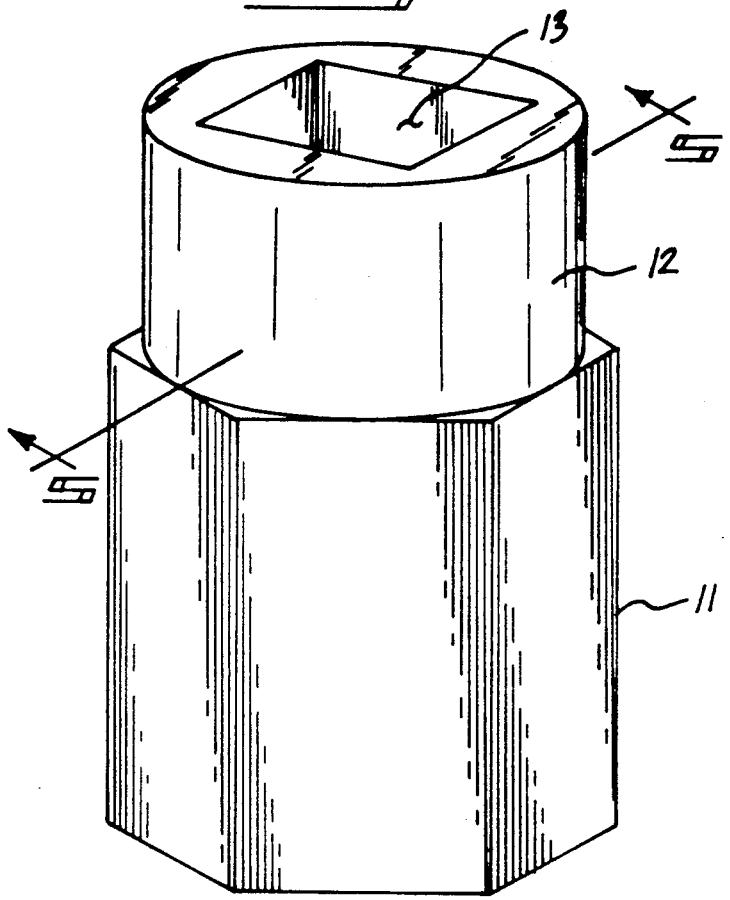
FIG. 2 is an isometric illustration of the instant invention.
Figure 3:
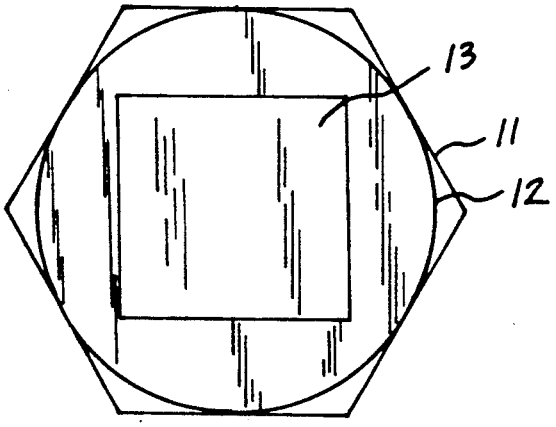
FIG. 3 is an orthographic top view of the invention.
Figure 4:
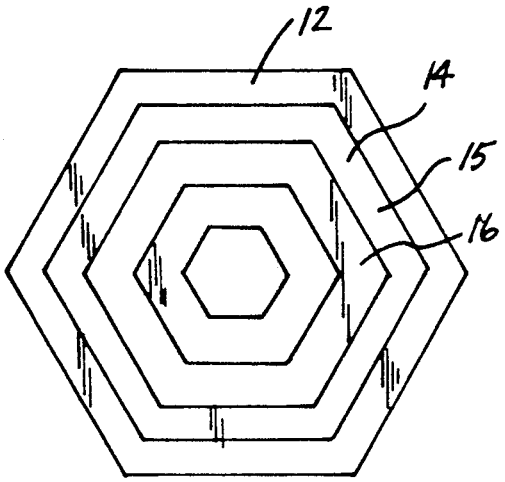
FIG. 4 is an orthographic bottom view of the invention.

An adapter plug 37, as illustrated in the FIG. 9, permits a screw driver and the like to be received within the adapter plug permitting ease of rotation of the socket structure in use. The adapter plug 37 includes an adapter plug projection 38 formed of a generally square parallelepiped configuration complementarily received within the square section bore 13. An adapter plug body 39 includes a slot 40 coaxially aligned relative to the adapter plug 37, wherein the slot 40 includes spaced parallel magnets 41 positioned on opposed sides of the slot to enhance securement of a screw driver fitting directed into the slot during use.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An adjustable socket apparatus, comprising, a main body formed about a central axis, wherein the main body includes an integral upper body coaxially aligned about the central axis integrally mounted to an upper terminal end of the main body, wherein the upper body includes a square section bore coaxially aligned with the central axis directed into the upper body, and the main body including a main body lower terminal end, and a main body cavity formed within the main body projecting into the main body coaxially aligned about the central axis projecting into the main body from the main body lower terminal end, and at least a first hexagonal tubular sleeve and a second hexagonal tubular sleeve concentrically mounted within the main body cavity in a first position, wherein the at least first sleeve and the second sleeve are arranged for displacement relative to one another in a coaxially aligned relationship within the main body cavity in a second position, and a first biasing means mounted within the main body cavity biasing the first sleeve to the first position, and a second biasing means mounted within the main body concentrically aligned with the first biasing means biasing the second sleeve into the first position, and the main body includes a main body interior surface directed into the main body cavity, wherein the interior surface includes a main body shoulder coaxially aligned relative to the central axis, wherein the main body shoulder is spaced from the main body lower terminal end a first spacing, and the first sleeve includes a first sleeve outer projection spaced from a lower terminal end of the first sleeve a space equal to the first spacing, and the first sleeve further including a first sleeve inner projection spaced from the lower terminal end of the first sleeve a second spacing, and the second sleeve including a second sleeve outer projection spaced from a lower terminal end of the first sleeve the second spacing, wherein the second spacing is greater than the first spacing, and the main body cavity includes a roof, wherein the roof is orthogonally oriented relative to the central axis and the roof includes a plurality of grooves defined by a first groove concentric with a second groove, the first groove aligned with and spaced above a first top surface of the first sleeve, with the second groove spaced above and aligned with a top surface of the second sleeve defined by a second top surface, and the first biasing means includes a first spring received within the first groove and mounted on the first top surface, and the second biasing means including a second spring concentric with the first spring received within a second groove and mounted on the second top surface, and a third sleeve concentric with the first sleeve and the second sleeve in the first position, wherein the second sleeve includes a second sleeve outer projection spaced from the lower terminal end of the second sleeve a third spacing, and the third sleeve includes a third sleeve outer projection spaced from a lower terminal end of the third sleeve the third spacing, and a third groove formed within the roof positioned above a top surface of the third sleeve defined by a third top surface, and including a third spring positioned within the third groove and mounted to the third top surface, wherein the third spring is concentric with the third spring and the second spring, and an oil injection port directed through the main body in fluid communication with the main body cavity, the port including a venturi plate mounted within the port, wherein the plate includes a plurality of splayed conduits projecting through the venturi plate, and an oil injection conduit arranged for securement to the port, the oil injection conduit in fluid communication with a reservoir to direct a lubricant into the port through the splayed conduits into the main body cavity.

2. An apparatus as set forth in claim 1 including an adapter plug, the adapter plug including a projection means, wherein the projection means is arranged for complementary reception within the square section bore, and the adapter plug including an adapter plug body coaxially aligned with the projection, the body including a top wall and the top wall including a slot, the slot coaxially aligned and directed into the body, and wherein the slot includes spaced parallel magnets mounted on opposed sides of the slot for securement of a drive member to be received therewithin.

* * * * *